US007942189B1

(12) United States Patent
Quraishi et al.

(10) Patent No.: US 7,942,189 B1
(45) Date of Patent: May 17, 2011

(54) REUSABLE WAX TREE SPRUE ROD ASSEMBLY FOR TREE MAKING IN LOST WAX INVESTMENT CASTING AND METHOD USE

(76) Inventors: Mashallah Quraishi, Albuquerque, NM (US); Khalid Mansoor, Albuquerque, NM (US)

( * ) Notice: Subject to any disclaimer, the term of this patent is extended or adjusted under 35 U.S.C. 154(b) by 123 days.

(21) Appl. No.: 12/148,015

(22) Filed: Apr. 16, 2008

(51) Int. Cl.
*B22C 7/02* (2006.01)
*B22C 9/04* (2006.01)

(52) U.S. Cl. ..... 164/35; 164/516; 164/246

(58) Field of Classification Search ..... 164/35, 164/516, 246
See application file for complete search history.

(56) References Cited

U.S. PATENT DOCUMENTS 4,283,831 A * 8/1981 Jhono ..... 29/423
4,651,801 A * 3/1987 Sasaki ..... 164/244

* cited by examiner

*Primary Examiner* — Kuang Lin

(57) ABSTRACT

The present invention is a novel sprue rod assembly for lost wax investment casting and its method of use. The sprue rod is reusable because it is made of material with a high melting point, such as metal, instead of wax. The sprue rod assembly also comprises a weight pull system, which causes the sprue rod to fall out of the investment mold when it is heated prior to dewaxing or early during dewaxing. The reusable sprue rod assembly reduces wasted wax, increases the efficiency of dewaxing and decreases flaws from the expansion of trapped wax during dewaxing. In addition, the sprue rods can be stacked to create the desired length.

22 Claims, 9 Drawing Sheets

REUSABLE WAX TREE SPRUE ROD ASSEMBLY FOR TREE MAKING IN LOST WAX INVESTMENT CASTING AND METHOD USE

BACKGROUND OF THE INVENTION

1. Technical Field of the Invention

This invention generally relates to investment casting, more specifically to lost wax investment casting using wax trees.

2. Description of the Background Art

Lost wax investment casting is a method of creating small molded metal designs. The casting process begins with a wax pattern made from a plastic master mold of the design. The wax pattern has one or more small wax rods, called gates, attached to it in strategically selected areas. The gates are welded onto a wax rod, called a sprue rod, typically at a 45 degree angle. The weld between the gate and the sprue rod is called the filet. The patterns can be welded radially, lengthwise or both. The sprue rod/wax pattern combination is called a wax tree. The bottom end of the sprue rod is inserted into a rubber base, which is then fitted onto the base of a metal flask. The resulting configuration consists of the wax tree being encapsulated by the flask without the patterns touching anything. The flask is filled with slurry, called investment, usually under vacuum pressure. Investment is similar to plaster, becoming hard in a matter of hours. Once the investment has hardened, the rubber base is removed from the flask, and the flask is placed into an oven or other heated space for the dewaxing cycle. During the wax removal, the wax melts and drips out, leaving a negative space where the wax tree used to be. The negative space is an exact duplicate of the wax tree, with the area where the sprue rod and gates were creating a path for molten metal to fill the patterns. The investment mold then cures in the heat, allowing it to withstand the temperatures of the molten metal. Finally, the molten metal is poured into the heated mold, creating a metal version of the wax tree. The investment is removed from the cooled metal, and the patterns can be removed from the tree.

Dozens of problems can arise during the lost wax investment casting process, resulting in casting defects ranging from minor flaws that can be reworked to irreparable defects that require recasting. One common problem results from wax melting within an enclosed space because the adjacent wax has not yet melted, blocking the wax's exit from the investment mold. Wax expands as it melts, causing problems for the investment mold. One of these problems is wax infiltrating pores in the investment mold. This wax can be extremely difficult to remove from the mold and can cause defects in the metal cast.

In addition to casting problems, the traditional wax sprue rod is completely lost in the dewaxing cycle. This is not only wasteful, but also represents a continuing expense that can be eliminated with a non-disposable reusable sprue rod.

SUMMARY OF THE INVENTION

The present invention comprises a reusable sprue rod assembly for lost-wax investment casting that presents several advantages over the traditional method of lost wax investment casting. The reusable sprue rod of the invention is preferably made of metal or ceramic that will not melt during the dewaxing cycle. The invention further comprises a cap that keeps investment out of the sprue rod; a weight that fits on the end of the sprue rod to aid the removal of the sprue rod during dewaxing; a locking mechanism to lock the weight into place on the sprue rod; a rubber base that holds the sprue rod in place by firmly engaging the weight while the wax tree is welded together and during the investment process; and a puller base and spring-loaded latch that locks onto the locking mechanism in place of the rubber base during the dewaxing cycle.

An object of the invention is to replace the wax sprue rod with a reusable sprue rod that can be removed during or prior to the wax removal cycle, allowing more wax to be removed from the investment mold, reducing problems with wax expansion during heating, and resulting in a substantial reduction in wasted wax. This can be accomplished by heating the sprue rod without heating the investment mold, as during traditional dewaxing. The sprue rod can be heated either because it is a conductive material or because it comprises a heating means, such as a nichrome wire.

Sprue rods are traditionally made of paraffin, which melts and is lost during the wax removal process. The sprue rod of the present invention is made of a material with a high melting point that will not melt as the rest of the wax tree melts. The material may be conductive, non-conductive, a combination of conductive and non-conductive materials or microwavable materials. The sprue rod may be a tube or a solid rod, may taper internally or externally and may have different cross-sections. The inner surface or outer surface may contain grooves for heating elements or additional wax. The sprue rod may have equally spaced rows of holes drilled at a 45 degree angle for accepting gates.

Another object of the invention is to allow for the use of patterns that are made of materials with higher melting points than wax. For instance, patterns made of metals with low melting points, such as Indium, can be welded to the sprue rod. This is not possible with wax sprues.

DETAILED DESCRIPTION OF THE INVENTION

The reusable sprue rod assembly of the present invention comprises a reusable sprue rod, a sprue rod cap, a weight means, a locking means, a rubber base, a spring-loaded latch and a puller base. The reusable sprue rod (1), shown in FIG. 1, has a high melting point and can be manufactured from a conductive material, a non-conductive material or a microwave susceptible material. Conductive materials include aluminum, stainless steel, copper, brass or sterling silver. Non-conductive and insulating materials include composite plastic, porous engineered ceramics, refractory ceramics and high temperature resistant silicone rubber. The sprue rod could be made of non-conductive microwave-safe materials. A sprue rod of this type would then be combined with a heating means, such as nichrome wire or silicon carbide grains, which could be sprinkled or coated on the sprue rod to make it heat in a microwave. The sprue rod can also be made of combinations of materials. For instance, a sprue rod could be made of non-conducting material with grooves on its exterior surface coated with conducting material.

Figure 7:
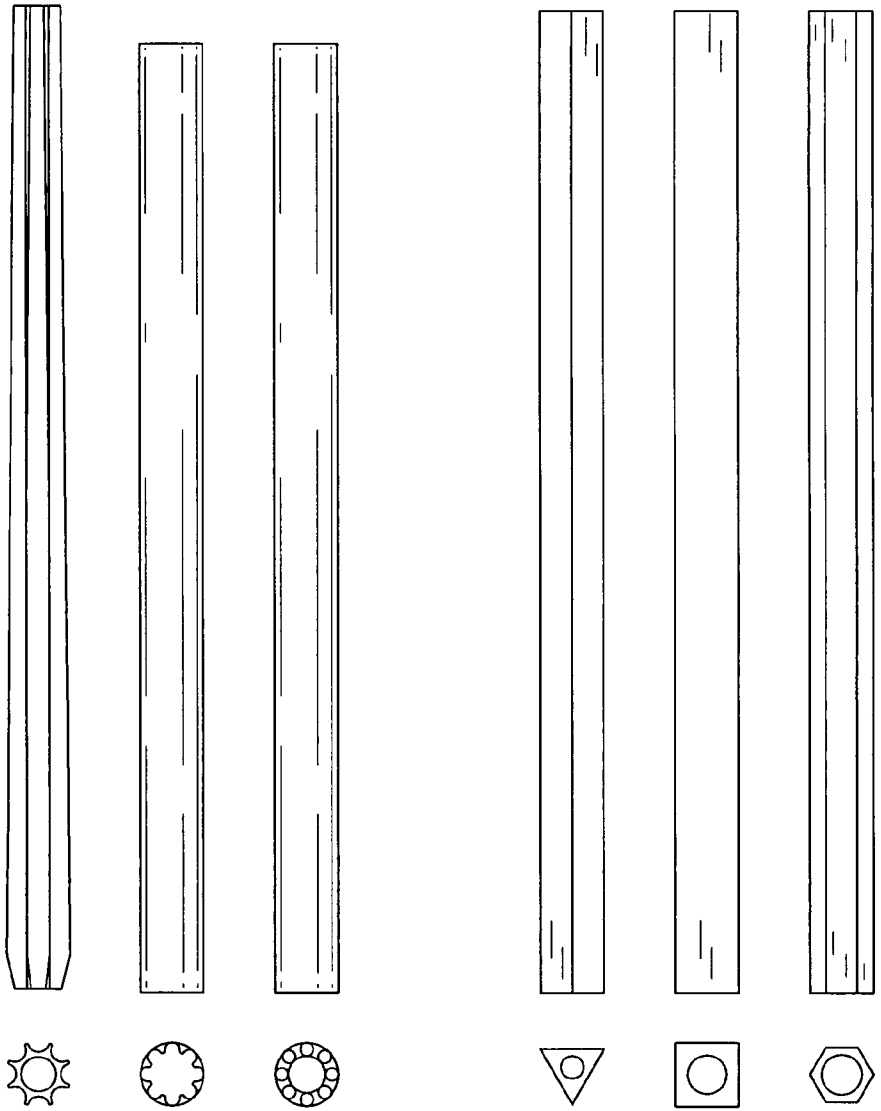
FIG. 7 depicts several alternative embodiments of the reusable sprue rod of the present invention.

The reusable sprue rod can be straight or tapered. If it is tapered, the outer diameter of the sprue rod or the inner diameter or both could be tapered. The sprue rod can have many different cross-sections, including most regular polygonal shapes, some of which are shown in FIG. 7. A sprue rod could also be a solid rod, rather than a tube. The length and diameter of the sprue rod can also vary. A series of straight sprue rods can also be stacked to create different lengths of sprue rods.

The reusable sprue rod (1) is a hollow tube fabricated from a material with a melting point above the melting point of wax, typically above 200 degrees Fahrenheit. The sprue rod comprises a top end (27), a body (28), a bottom end (29), an interior surface, an exterior surface and a central axial opening (30). The top and bottom ends of the sprue rod are open. A metal or wax sprue rod end cap (6), shown in FIG. 2, fits into and seals the hole in the top end of the sprue rod. The sprue rod end cap is capable of preventing wax, investment and other liquids from seeping through the top end of the sprue rod when in place.

Figure 9:
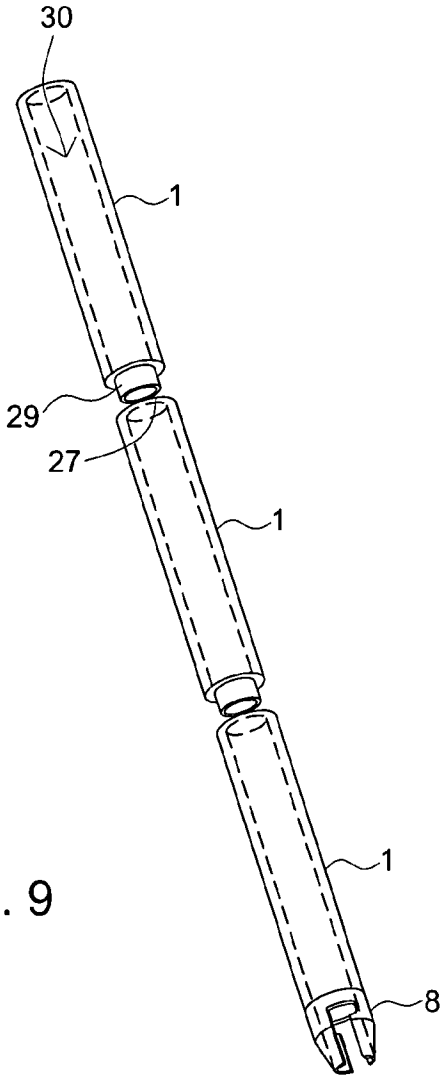
FIG. 9 is a perspective view of an alternative embodiment of the invention (Example 4), wherein a series of reusable sprue rods are stacked to extend the length of the sprue rod.

The bottom end (29) of the sprue rod, as shown in FIG. 9, engages a hollow end member (8) that is welded, glued or threaded into place on the open bottom end. In the preferred embodiment of the invention, the hollow end member is permanently affixed to the sprue rod. In alternative embodiments, the hollow end member can be pulled or threaded off of the sprue rod. The hollow end member comprises an inner diameter, an outer diameter, a crown, a center and a base. The inner diameter is constant from the base to the crown and matches the diameter of the sprue rod's central axial opening, essentially extending the central axial opening to the base of the end member. The outer diameter matching being such that the crown can fit snugly inside the bottom end of the sprue rod, the diameter widening to match the diameter of the diameter of the sprue rod's exterior surface below the crown, the diameter tapering from the center of the end member to the base. The end member further comprises two opposing L-shaped notches (7). The notches each comprise a vertical portion, a 90 degree turn, and a horizontal portion. Each notch begins with the vertical portion extending perpendicularly from the base of the end member through the center, the 90 degree turn and then the horizontal portion extending towards the other notch, parallel to the base of the end member. The horizontal portion is shorter than the vertical portion. The notches are capable of engaging the locking bar of the locking means, described below. The horizontal portion comprises a width and the vertical portion comprises a height.

In an alternative embodiment of the invention, the end member is a machine cut from the same piece of rod material as the reusable sprue rod, so the end member is an extension of the sprue rod that does not have to be welded or slip fit into place. This embodiment works best with a sprue rod that has a constant inner diameter, rather than a diameter that tapers. When the sprue rod has a tapering inner diameter, the end member is preferably welded into place.

Figure 3:
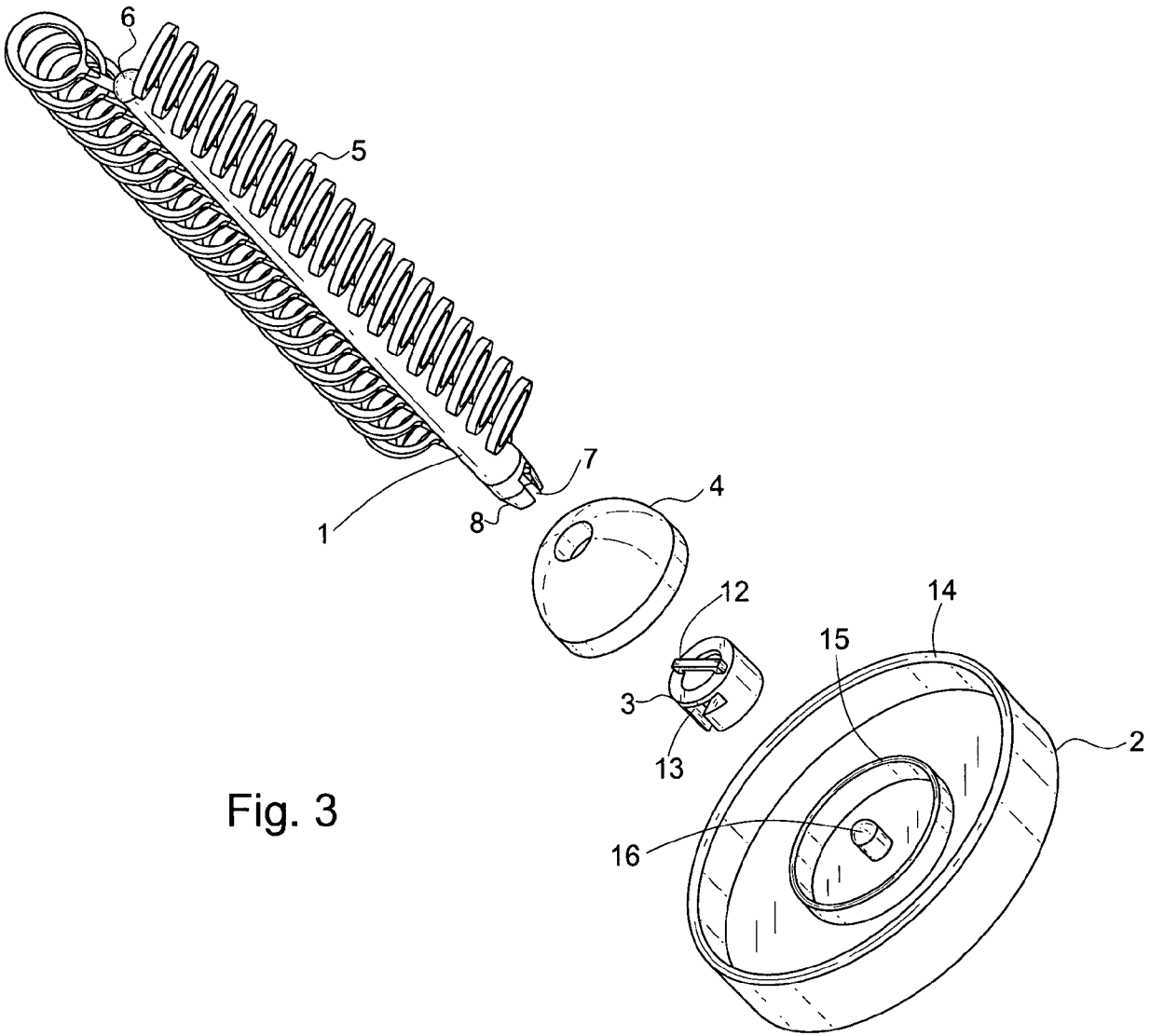
FIG. 3 is an exploded view of the sprue rod, weight means, locking means and rubber base.

The weight means (4), shown in FIG. 3, comprises a hemispherical weight, the weight comprising an apex, a base, a top opening at the apex of the weight, a bottom opening in the base of the weight and a channel extending from the top opening to the bottom opening. The diameter of the top opening is smaller than the diameter of the bottom opening. The bottom opening is sized so that the locking means (3) can fit through the bottom opening into the channel. The bottom opening can be reverse threaded, so that the locking means can be screwed into the weight means. Otherwise, the locking means can be welded into the bottom opening of the weight means to create a single piece. The weight means' function is to weigh down the sprue rod, helping the sprue rod to automatically disengage from the investment mold during the dewaxing cycle, due to the additional pull of gravity, allowing the wax from the wax patterns and gates to drain more completely and easily. Another function of the weight means is to interface with the raised inner circle of the modified rubber base, holding the sprue rod in the rubber base.

The locking means (3), shown in FIG. 3, fits inside the bottom opening and channel of the weight means (4), but is too large in diameter to fit through the top opening of the weight means. The function of the locking means is to lock the weight means onto the sprue rod by engaging the notches in the end member of the sprue rod and to connect the puller base to the sprue rod by engaging the spring-loaded latch. The locking means is a hollow cylinder that comprises a top end, a body, a bottom end, an inner diameter and an outer diameter. The outer diameter is slightly smaller than the diameter of the bottom opening of the weight means and larger than the diameter of the top opening of the weight means, so that the locking means can be inserted into the weight means. The top end of the locking means comprises a flat outer surface, a center opening, and a locking bar (12) that spans the center opening. The center opening is slightly larger in diameter than the bottom end of the sprue rod, so that the sprue rod can be inserted into the opening if the notches in the end member are aligned with the locking bar. The center opening extends from the top end to the bottom end of the locking means. The locking bar comprises a rectangular prism, which comprises a length, height and width. The length is longer than the diameter of the center opening, but shorter than the diameter of the hollow cylinder of the locking means. The locking bar is slightly narrower in width than the horizontal portion of the L-shaped notch (7) in the end member (8) of the sprue rod and slightly shorter in height to the vertical portion of the same L-shaped notch. These dimensions allow the locking bar to be pushed up through the vertical portion of the notch until the locking bar meets the 90 degree turn and then rotated to slide the locking bar into the horizontal portion of the notch. The dimensions are close in size, ensuring a snug fit that requires some pressure to move the rod within the notch. The locking bar is fixedly attached to the flat surface of the top end of the locking means, extending across the widest part of center opening. The body comprises two opposing L-shaped notches (13), the notches comprising a vertical portion, a 90 degree turn, and a horizontal portion. Each notch begins with the vertical portion extending perpendicularly from the bottom end of the locking means towards the top end, the 90 degree turn and then the horizontal portion extend towards the other notch, parallel to the bottom end of the locking means. The horizontal portion is shorter than the vertical portion. The notches are capable of engaging the projections of the spring-loaded latch, described below. The horizontal portion comprises a width and the vertical portion comprises a height. The bottom end of the locking means comprises a flat outer surface bisected by the notches and a center hole. The locking means is locked onto the sprue rod by inserting the sprue rod through the weight means and into the center opening of the locking means when the locking bar and the sprue rod's notches are aligned. Either the sprue rod or the locking means is then rotated so that the locking bar slips into the horizontal portion of the sprue rod's notches.

Figure 2:
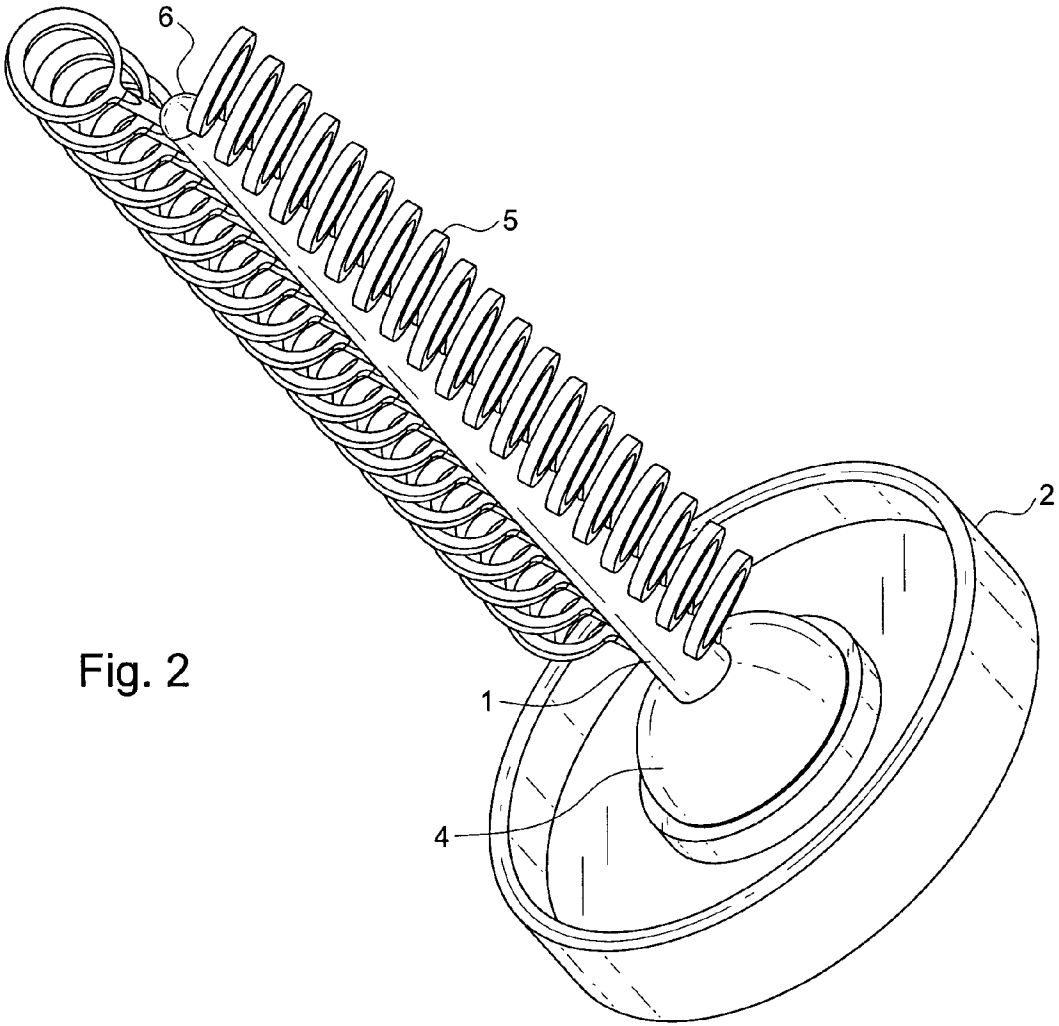
FIG. 2 is a perspective view of the assembled invention with rows of wax patterns welded onto the reusable sprue rod.

The circular rubber base (2), shown in FIG. 3, comprises a top side, a bottom side, an outer edge and a center. Rubber bases are common in lost wax casting, however, the top side of the rubber base of this invention is different from the typical rubber bases in the art to accommodate the reusable sprue rod and weight pull system. The bottom side of the rubber base is flat. The top side of the rubber base comprises a raised outer circle, a raised inner circle and a round center nub (16) in the center of the rubber base. The two circles are concentric. The outer raised circle (14) is located at the outer edge of the base's top side. Its circumference is such that it snugly fits over the outer circumference of an investment flask (23), which will be used during the investment casting process. The inner raised circle (15) is between the outer raised circle and the center nub. Its diameter is such that the base of the weight means (4) fits snugly within it, as shown in FIG. 2. The round center nub (16) has a diameter slightly shorter than the inner diameter of the locking means (3) and the central axial opening of the sprue rod. When the weight means with the locking means inside of it is pressed onto the rubber base, the base of the weight means (4) is engaged by the raised inner circle (15), and the center nub (16) of the rubber base engages the center opening of the locking means (3) and the central axial opening (30) of the sprue rod. The rubber base (2) is engaged to the locking means, weight means and sprue rod, allowing the sprue rod to be positioned vertically on the rubber base. This assembly can take place before or after the patterns (5) are welded onto the sprue rod, but must be in place for the investment process. The rubber base (2) is removed when the investment has hardened and is replaced by the puller base (10), which attaches to the locking means (3) via the spring-loaded latch.

Figure 4:
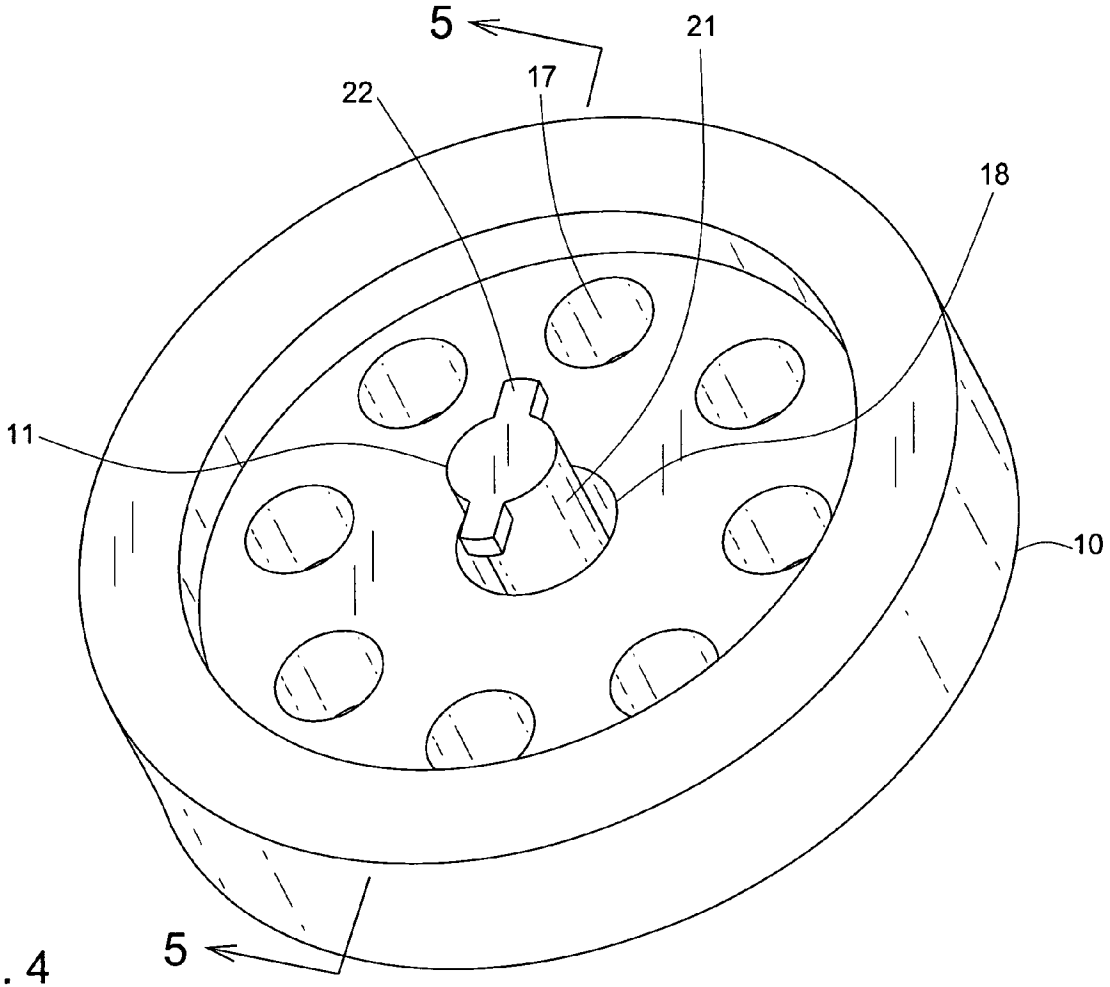
FIG. 4 is a perspective view of the puller base and spring-loaded latch.

The puller base (10), shown in FIG. 4, is circular and comprises a top side, a bottom side, an outer circumference, and a center hole (18). The center hole extends from the bottom side to the top side and acts as a slip-fit hole for the spring-loaded latch (11). The base further comprises a plurality of drain holes (17) around the center hole, the drain holes extending from the top side to the bottom side and being capable of allowing molten wax to flow through them. The bottom side of the base is flat. The outer circumference of the base is flush with the bottom side, but is raised above the top side, creating a raised rim that contains the molten wax that drips onto the top side during the dewaxing cycle, preventing leakage during dewaxing and promoting drainage of the molten wax through the drain holes. The center hole comprises a bottom diameter, a flat circular area (19), and a top diameter. The bottom diameter is larger than the top diameter. Examining the center hole from the bottom side to the top side, the large diameter at the bottom is necked down before reaching the top side, creating the flat circular area (19) parallel to the top side and the bottom side.

Figure 5:
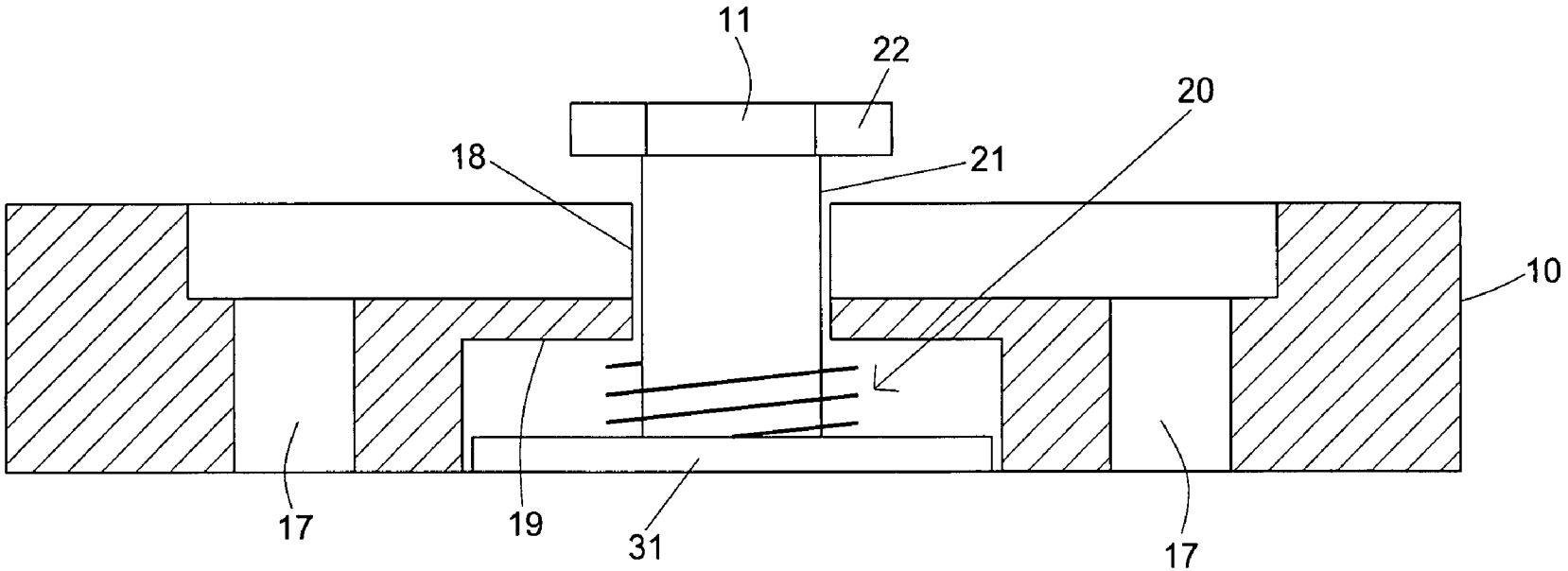
FIG. 5 is a cross-section of the puller base and spring loaded latch, showing the compression coil spring within the center hole of the base.

The spring-loaded latch (11) is slip-fit into the center hole (18) of the puller base (10), as shown in FIGS. 4 and 5, and engages the notches in the locking means, locking the puller base onto the sprue rod, weight means and locking means. The latch comprises top end, a cylindrical central rod (21), and a bottom end (31). The top end of the latch comprises a circular center and two opposing rectangular projections (22), similar to the locking bar (12) of the locking means (3). The circular center's diameter is identical to the diameter of the central rod. The top end's circular center and projections create a flat surface, which is parallel to the latch's bottom end (31). The projections comprise a height and a width. The projections are sized to fit into the L-shaped notches (13) in the bottom end of the locking means, with their height being slightly smaller than the height of the horizontal portion of the notches and their width being slightly smaller than the width of the vertical portion of the notches. The projections and notches fit together the same way as the locking bar of the locking means and the notches of the sprue rod's end member. The top end of the latch is capable of fitting through the puller base's center hole, allowing the latch to be fully inserted into the puller base and allowing the projections to extend out the top side of the puller base. The diameter of the central rod is smaller than the top diameter of the puller base, allowing the central rod to slip inside through the center hole of the puller base. The central rod comprises a compression coil spring (20), shown in FIG. 5. The spring comprises a strip of flexible metal coiled around the central rod and resting on the bottom end of the latch. The bottom end of the latch (31) comprises a round disc with a diameter larger than that of the central rod, the diameter being slightly smaller than the bottom diameter of the puller base and larger than the top diameter of the puller base. The bottom end comprises an inner surface and an outer surface. The compression coil spring (20) rests on the inner surface of the bottom end. The outer surface is capable of being used as a knob to engage and disengage the latch, and hence the puller base, to and from the locking means by applying pressure with the thumb or fingers. When the spring loaded latch is inserted into the puller base, the inner surface of the bottom end faces the flat circular area (19) created by the necked down area inside the puller base's center hole and the compression coil spring (20) comes in contact with the flat circular area (19). When pressure is applied to the bottom end of the latch (31), the spring compresses between the bottom end of the latch and the flat circular area. When such pressure is applied, the top end of the latch and its projections protrude from the top of the puller base. The top end of the latch can then be inserted into the locking means if the projections and the locking means' notches are aligned. The combined puller base/latch can be locked onto the locking means by applying pressure to the outer surface of the bottom end of the latch (31), aligning the projections (22) with the notches (13) in the locking means, inserting the top end of the latch into the center opening of the locking means, and turning the bottom end of the latch so that the projections are locked into the horizontal portion of the locking means' notches. When locked together, the compression spring of the latch is under pressure, which assists the sprue rod assembly in coming free from the investment mold during dewaxing or when the sprue rod assembly is heated.

Various diameters of rubber bases and puller bases can be produced to coincide with different sizes of flasks. The size of the flask used will vary based on how far the wax patterns protrude from the sprue rod. Making certain that there is sufficient clearance between the sides of the flask and the wax patterns ensures that the investment mold will be thick enough to resist cracking or breaking when molten metal is poured into it. The rubber base does not have to be circular, if another shape is advantageous is a certain situation.

In addition, the weight means does not have to be dome-shaped. It could be manufactured in any number of shapes, so long as it still performs its function. However, the shape of the raised inner circle of the rubber base would also need change to accommodate the shape of the base of the weight means.

The method of use of the apparatus of the present invention is as follows. First, the reusable sprue rod (1) is dipped into a reservoir of molten wax to lightly coat its entire length with wax. Next, the sprue rod (1), weight means (4), locking means (3) and rubber base (2) must be assembled. In the preferred embodiment, the weight means and locking means are welded together. In other embodiments, the locking means must be placed or screwed into the weight means by inserting the top end of the locking means into the bottom opening of the weight means. The notches (7) on the bottom end of the sprue rod are aligned with the locking bar (12) of the locking means. The bottom end of the sprue rod is inserted through the top opening in the weight means (4) and into the center opening in the top end of the locking means (3). The notches (7) on the bottom end of the sprue rod engage the locking bar (12) of the locking means. The sprue rod (1) is then rotated, so that the locking bar (12) slides into the horizontal portion of the sprue rod's notches, locking the sprue rod to the weight means and locking means. The rubber base (2) is then attached to the assembly by lining up the inner raised circle (15) of the rubber base and the base of the weight means (4). This also aligns the center nub (16) of the rubber base with the center opening in the bottom end of the locking means (3). The rubber base is firmly pressed onto the assembly, so the inner raised circle (15) firmly encapsulates the base of the weight means (4), as pictured in FIG. 3.

Next, the assembled sprue rod assembly can be clamped or otherwise attached to a jig, where the wax patterns (5) are welded onto the sprue rod. Alternatively, the wax (or other) patterns can be welded to the sprue rod after placing the sprue rod assembly on a flat working surface. Once the wax patterns have been welded onto the sprue rod, as pictured in FIG. 3, a metal investment flask (23) is placed over the wax tree and inserted into the rubber base (2), interfacing with the outer circle (14) of the rubber base to hold the flask firmly in place. Investment is poured into the flask and allowed to harden into an investment mold.

Figure 6:
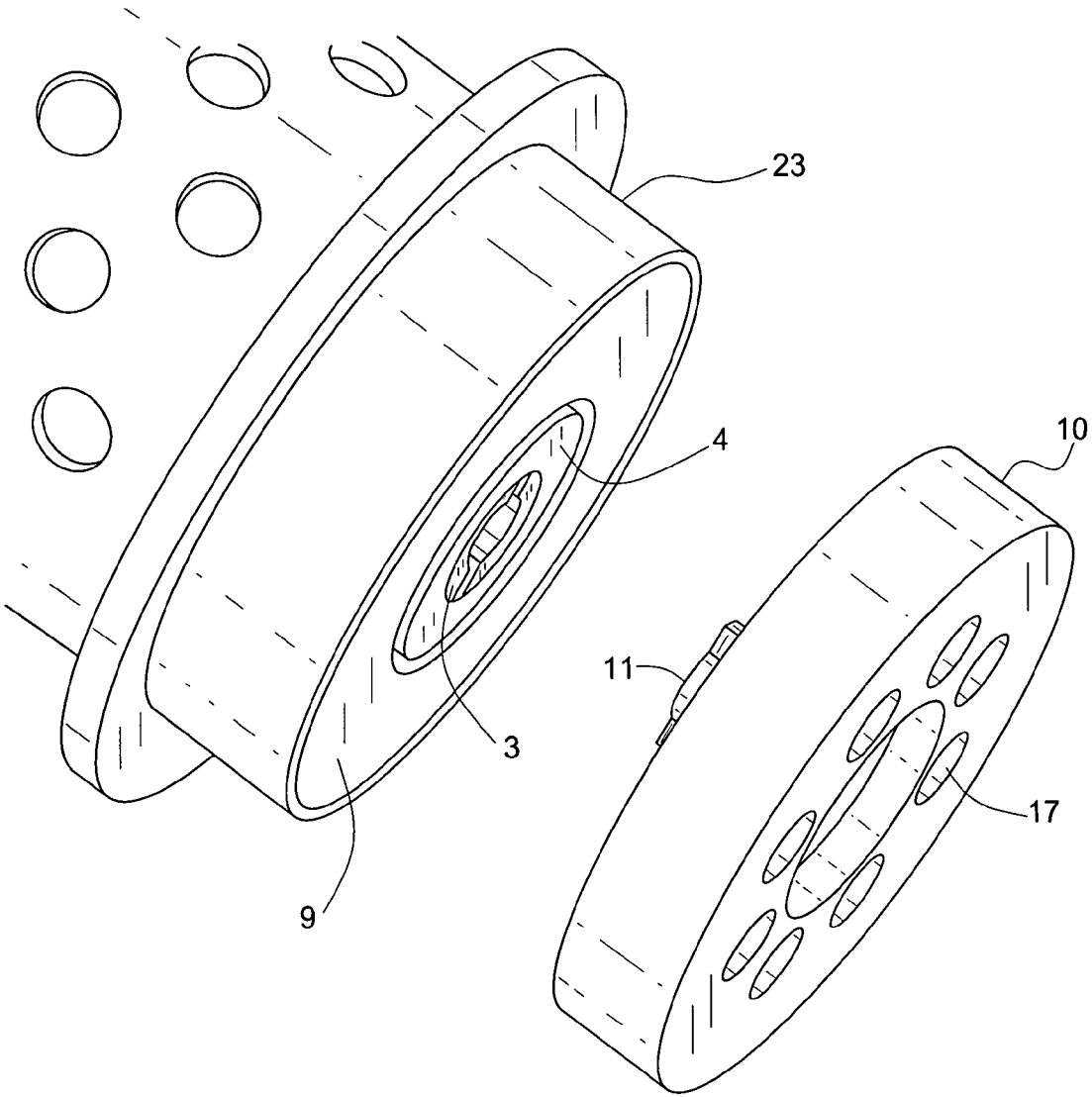
FIG. 6 is a perspective view of the puller base in position to lock into the locking means.

Once the investment mold (9) is completely hardened, the rubber base (2) is pulled off of the assembly and is replaced by the puller base (10) and spring-loaded latch (11). In order to lock the puller base onto the sprue rod assembly, the spring loaded latch must be inserted, top end first, into the center hole in the bottom side of the puller base and the puller base must be lined up with the base of the flask, as shown in FIG. 6. Pressure must be applied by a finger or other pushing means against the bottom end spring-loaded latch (11), so that the top end of the latch protrudes from the top side of the puller base. Next, the projections (22) on the top end of the latch are lined up with the notches (13) of the locking means. The top end of the latch is inserted into the bottom end of the locking means (3) by applying additional pressure to the latch's bottom end, so that the projections (22) of the latch enter the notches (13) of the locking means and the compression spring is compressed. The latch's bottom end is then turned while maintaining pressure on the latch, locking the puller base onto the sprue rod assembly by engaging the projections with the horizontal portion of the notch. This new assembly is then suspended base down in an oven or other heated or steam-filled space for the dewaxing cycle. While the metal sprue rod is heating, the wax can escape from the investment mold by running down the metal sprue rod and dripping out the drain holes (17) in the puller base (10). The reusable sprue rod will quickly become hot enough to disengage from the investment mold (9) because of the pressure from the spring-loaded latch (22) combined with the weight of the weight means (4) and the sprue rod (1). The sprue rod assembly can then be removed from the heated space. This leaves a central void in the investment mold where the remaining wax can escape as it melts. The rest of the investment casting process (the rest of dewaxing, heat-treating the investment mold, casting with molten metal or other material, and removing the cast pieces from the tree) is followed in the traditional manner.

In an alternative method, prior to the dewaxing cycle, the sprue rod assembly is heated and removed. This leaves a central void where the sprue rod was, allowing wax to easily escape the investment mold as it melts. The difference between this alternative method and the preferred method is that the sprue rod is removed earlier, eliminating problems with wax being unable to escape from the outset of dewaxing.

The specific apparatus and method described herein are representative of preferred embodiments and are exemplary and not intended as limitations on the scope of the invention. Other objects, aspects, and embodiments will occur to those skilled in the art upon consideration of this specification, and are encompassed within the spirit of the invention as defined by the scope of the claims.

Preferred Embodiment of the Invention

Figure 1:
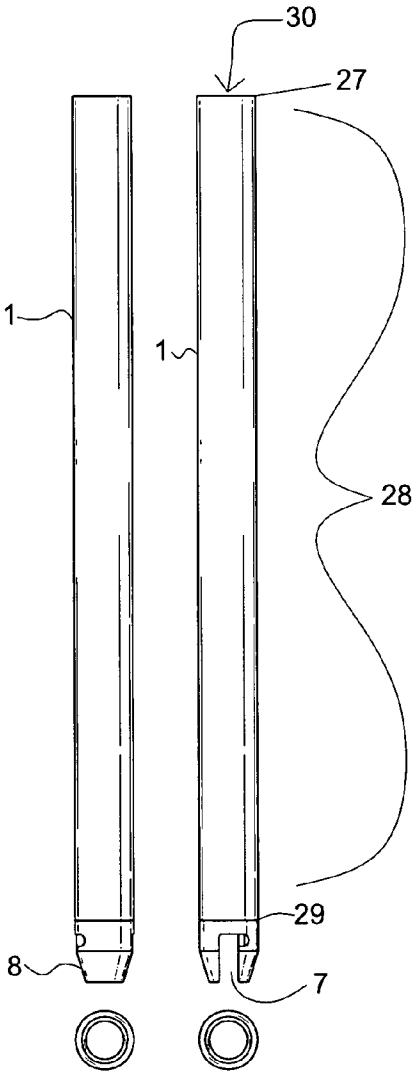
FIG. 1 is a front and side elevational view of the preferred embodiment of the reusable sprue rod and its cross section.

In the preferred embodiment of the invention, the reusable sprue rod is made of a conductive metal. The exterior surface of the sprue rod tapers slightly, with the bottom end having a larger diameter than at the top end, as shown in FIG. 1. The interior surface is not tapered.

In the preferred embodiment, the weight means (4) and locking means (3) of the weight pull system are welded together into a single unit. The end member is also welded into the bottom end of the sprue rod.

Alternative Embodiments of the Invention

Example 1

In an alternative embodiment, the reusable sprue rod comprises a plurality of holes drilled at a 45 degree angle in rows and columns along its length. The holes are all the same size, with a diameter corresponding to a common gate diameter. The gates could then be directly inserted into the holes, assuring the perfect uniform angle for all of the wax pattern welds. A filet must still be created around the gate/hole interface after insertion of the wax pattern. This embodiment can be manufactured with different sizes and configurations of holes, as well as the holes being drilled at varying angles.

Example 2

Figure 8:
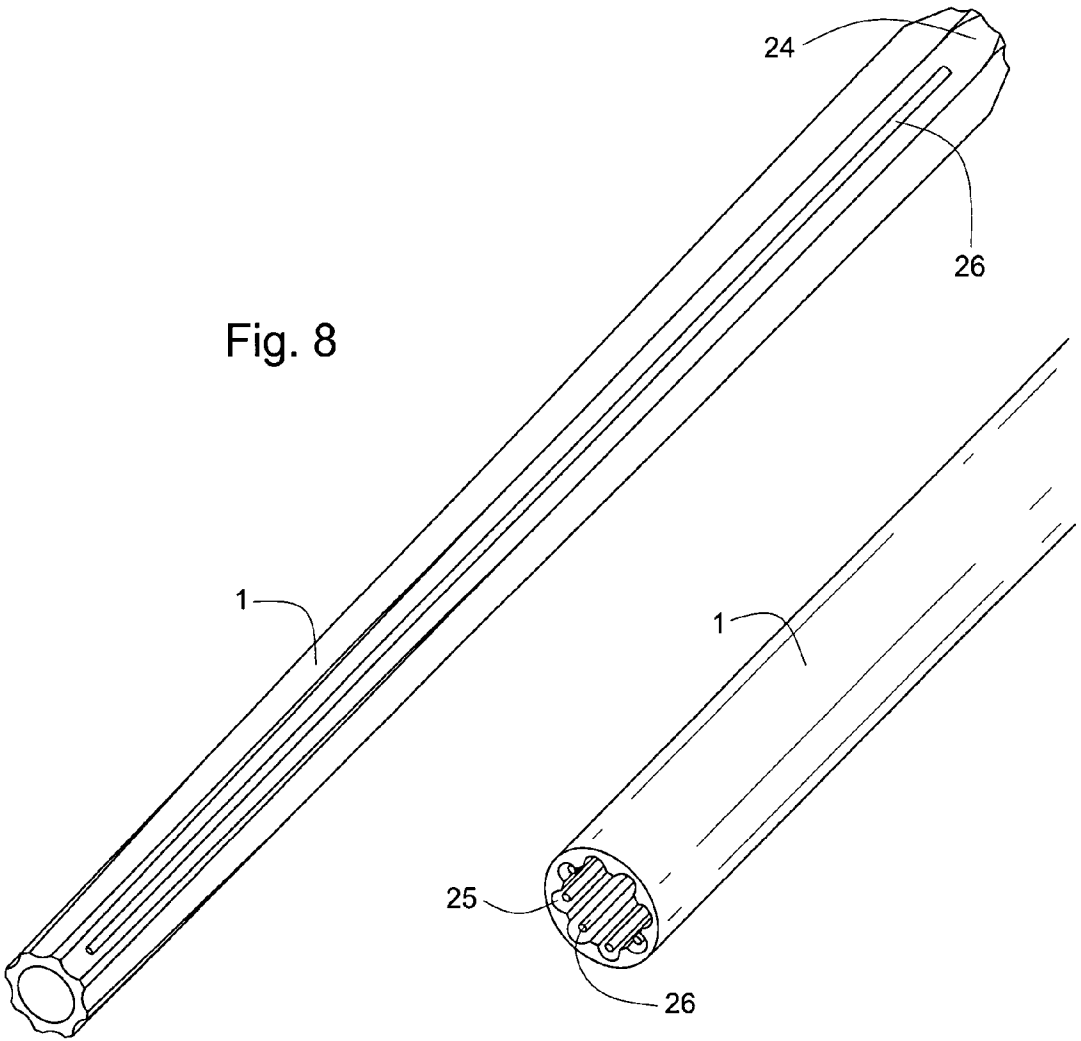
FIG. 8 is a perspective view an alternative embodiment of the invention (Example 2), wherein the reusable sprue rod comprises internal or external grooves for nesting a heating means.

The reusable sprue rod can comprise grooves in the exterior surface (24) or the interior surface (25). The grooves can be of various depths. Such grooves can comprise heating elements, preferably nichrome heating wires or strips extending through the length of the groove. These heating elements can be fixed, as shown in FIG. 8, or movable. The sprue rod can be a non-conductive metal if it has external grooves (24) and heating wires (26).

In addition, external grooves can be filled with melted wax prior to assembling the sprue rod assembly. The wax-filled grooves form reservoirs of wax that can be heated to facilitate welding of wax patterns and filet creation. If the area where a wax pattern is going to be welded is heated to locally melt the wax in the groove, the gate of the wax pattern can be inserted into the heated groove and then pulled back slightly and held in place until the wax solidifies, producing a nice, smooth filet that will minimize turbulence and inclusions when the molten metal is poured into the investment mold.

A smooth filet can reduce inclusions, which are caused by sharp edges of investment that break off when molten metal is poured into the investment mold. A smooth filet also reduces turbulence in the molten metal as it is poured into the investment mold. Turbulence can cause gas bubbles in the metal cast, resulting in porosity in the cast pieces.

Example 3

In another alternative embodiment of the invention, the sprue rod comprises a heating element that runs along the length of the sprue rod's interior. The heating element is sized to fit within the sprue rod. After the investment mold has hardened, the heating element can be connected to a power source, facilitating the removal of the sprue rod assembly as the wax surrounding the sprue rod softens and melts. Early removal of the sprue rod provides a great advantage in dewaxing the investment mold, as it is easier for the wax to exit the mold through the large cavity left by the sprue rod.

Example 4

Another alternative embodiment of the invention is a stackable sprue rod assembly. Two or more sprue rods are stacked vertically to create a single stacked sprue rod of the desired length, as depicted in FIG. 9. The rest of the sprue rod assembly and method of use remain the same as in the preferred embodiment. In this alternative embodiment, there is a top sprue rod and a bottom sprue rod, and there may be center sprue rods, depending on the desired length.

The top sprue rod can have an end cap (6) at its top end that press fits in place. The top sprue rod does not have a hollow end member at its bottom end. The bottom sprue rod does not have an end cap, but does have a hollow end member (8) threaded or press-fit onto the bottom end of the sprue rod. Any center sprue rods do not engage end caps or end members. The bottom end of each sprue rod fits snugly into the top end of another sprue rod, meaning that the interior diameter of the top end is slightly larger than the exterior diameter of the bottom end. The bottom end of each sprue rod is capable of being press-fit into the top end of any other sprue rod.

In an alternative embodiment of this embodiment, the sprue rods have any threading and reverse threading, so that they can be screwed together, rather than being press-fit together. Every sprue rod's interior surface at the top end of the sprue rod is reverse threaded. Each sprue rod's bottom end is threaded on the exterior surface. The threading on the bottom end of one sprue rod is capable of being threaded into the top end of another sprue rod.

The invention claimed is:

1. A reusable wax tree sprue rod assembly, comprising:

a. a reusable sprue rod comprising a hollow tube fabricated of material with a high melting point, the tube comprising a top end, a body, a bottom end, an interior surface, an exterior surface, and a central axial opening, the central axial opening extending from the top end to the bottom end, the top and bottom ends being open to the central axial opening, the diameter of the central axial opening being the same throughout the length of the tube, the diameter of the exterior surface tapering slightly and being larger at the bottom end than at the top end;

b. a removable sprue rod end cap, comprising a dome-shaped plug sized to firmly engage the top end of the sprue rod, the end cap being capable of sealing the top end of the sprue rod and preventing wax and investment from entering the opening in the top end of the sprue rod;

c. a hollow end member capable of firmly engaging the bottom end of the sprue rod, the end member comprising an inner diameter, an outer diameter, a crown, a center and a base, the inner diameter being constant from the base to the crown, the outer diameter at the crown being such that the crown can fit snugly inside the bottom end of the sprue rod, the outer diameter widening below the crown to match the diameter of the diameter of the sprue rod's exterior surface, the diameter tapering from the center of the end member to the base, the end member further comprising two opposing L-shaped notches, the notches comprising a vertical portion, a 90 degree turn, and a horizontal portion, the vertical portion extending perpendicularly from the base of the end member through the center, terminating at the 90 degree turn, the horizontal portion extending towards the other notch, parallel to the base of the end member, the horizontal portion being shorter than the vertical portion, the horizontal portion comprising a width and the vertical portion comprising a height;

d. a weight means capable of adding sufficient weight to the sprue rod to cause the sprue rod to automatically disengage during dewaxing, the weight means also being capable of sliding onto the bottom end of the sprue rod, the weight means comprising a hemispherical weight, the weight comprising an apex, a base, a top opening at the apex of the weight, a bottom opening in the base of the weight and a channel extending from the top opening to the bottom opening, the diameter of the top opening being larger than the diameter of the bottom opening;

e. a locking means capable of locking the weight means onto the reusable sprue rod, the locking means further being capable of press-fitting into the bottom opening and channel of the weight means, the locking means comprising a hollow cylinder, which further comprises a locking bar, a top end, a bottom end, an inner diameter and an outer diameter, the outer diameter being slightly smaller than the diameter of the bottom opening of the weight means and larger than the diameter of the top opening of the weight means, top end of the locking means comprising a flat outer surface, a center opening, and the locking bar, the locking bar spanning the center opening, the diameter of the center opening being slightly larger than the bottom end of the sprue rod, the center opening extending from the top end to the bottom end of the locking means, the locking bar comprising a rectangular prism, the rectangular prism comprising a length, height and width, the length being longer than the diameter of the center opening and shorter than the diameter of the hollow cylinder of the locking means, the width being slightly narrower than the horizontal portion of the L-shaped notch in the end member of the sprue rod and slightly shorter in height to the vertical portion of the end member's L-shaped notch, the locking bar being fixedly attached to the flat surface of the top end of the locking means, extending across the widest part of center opening and top end, the body of the locking means comprising two opposing L-shaped notches, each notch comprising a vertical portion extending perpendicularly from the bottom end of the locking means towards the top end, the 90 degree turn and then the horizontal portion extend towards the other notch, parallel to the bottom end, the horizontal portion comprising a width, the vertical portion comprising a height, the bottom end of the locking means comprising a flat outer surface bisected by the notches and a center hole;

f. a circular rubber base, comprising an outer edge, a center, a top side and a bottom side, the bottom side being flat, the top side comprising a concentric outer raised circle, an inner raised circle, and a round center nub, the outer raised circle being located at the outer edge of the top side, the inner raised circle is located between the outer raised circle and the center nub, its circumference being such that the base of the weight means fits snugly within it, the center nub having a diameter such that it snugly fits within the inner diameter of the locking means and the center axial opening of the sprue rod;

g. a circular puller base comprising a top side, a bottom side, an outer circumference, and a center hole extending from the top side to the bottom side, the puller base further comprising a plurality of drain holes around the center hole, the drain holes extending from the top side to the bottom side, the bottom side being flat, the outer circumference being flush with the bottom side, the outer circumference being raised above the top side, creating a raised rim capable of containing molten wax, the center hole comprising a bottom diameter, a flat circular area, and a top diameter, the bottom diameter being larger than the top diameter, and the flat circular area being created where the larger diameter is necked down to the smaller diameter, the flat area being parallel to the top side and the bottom side of the puller base; and h. a spring-loaded latch capable of slip-fitting into the center hole of the locking means and engaging the notches of the locking means, the latch comprising a top end, a cylindrical center rod, and a bottom end, the top end comprising a circular center and two opposing rectangular projections, the circular center's diameter being identical to the diameter of the center rod, the circular center and the projections being parallel to the latch's bottom end, the projections comprising a height and a width, and the projections being capable of fitting into the L-shaped notches in the bottom end of the locking means, the projections' height and width being slightly smaller than the height and width of the notches, the top end of the latch being capable of fitting through the top diameter of the center hole in the puller base, allowing the latch to be fully inserted into the puller base, the cylindrical center rod comprising a compression coil spring, the compression coil spring comprising a strip of flexible metal coiled around the cylindrical center rod, the compression spring resting on the bottom end of the latch, the center rod comprising a diameter that is smaller than the top diameter of the puller base, the bottom end comprising a round disc with a diameter larger than the central rod, the diameter being slightly smaller than the bottom diameter of the center hole in the base and larger than the top diameter of the center hole in the base, the bottom end comprising an inner surface and an outer surface, the compression spring resting on the inner surface, the outer surface being capable of functioning as a knob that engages and disengages the latch from the locking means when pressure is applied to the outer surface.

2. The reusable wax tree sprue rod assembly according to claim 1, wherein the sprue rod is made of a conductive metal selected from a group consisting of aluminum, stainless steel, copper, brass and sterling silver.

3. The reusable wax tree sprue rod assembly according to claim 1, wherein the sprue rod is made of a non-conductive and insulating material selected from a group consisting of composite plastic, porous engineered ceramics, refractory ceramics and high temperature-resistant silicone rubber.

4. The reusable wax tree sprue rod assembly according to claim 1, wherein the sprue rod is made of a material that is microwave-safe and microwave-susceptible.

5. The reusable wax tree sprue rod assembly according to claim 1, wherein the sprue rod is made of a combination of conductive and non-conductive materials.

6. The reusable wax tree sprue rod assembly according to claim 1, wherein the sprue rod is solid and lacks an interior surface.

7. The reusable wax tree sprue rod assembly according to claim 1, wherein the exterior surface of the sprue rod's body is tapered along its length, resulting on one end having a larger diameter than the other end.

8. The reusable wax tree sprue rod assembly according to claim 1, wherein the interior surface of the sprue rod's body is tapered along its length, resulting on one end having a larger diameter than the other end.

9. The reusable wax tree sprue rod assembly according to claim 1, wherein both the exterior and interior surfaces of the sprue rod's body are tapered along the length of the sprue rod, resulting on one end having a larger diameter than the other end.

10. The reusable wax tree sprue rod assembly according to claim 1, wherein the exterior surface of the sprue rod comprises a plurality of longitudinal grooves, the longitudinal grooves being capable of engaging a nichrome heating wire or microwave safe microwave susceptible lining.

11. The reusable wax tree sprue rod assembly according to claim 1, wherein the interior surface of the sprue rod comprises a plurality of longitudinal grooves, the longitudinal grooves being capable of engaging a nichrome heating wire or microwave safe microwave susceptible lining.

12. The reusable wax tree sprue rod assembly according to claim 1, wherein the exterior surface of the sprue rod comprises a plurality of rows of holes set at a 45 degree angle of inclination, the holes being capable of engaging wax pattern gates.

13. The reusable wax tree sprue rod assembly according to claim 1, wherein the cross-section of the sprue rod's exterior surface is polygonal.

14. The reusable wax tree sprue rod assembly according to claim 1, wherein the cross-section of the sprue rod's interior surface is polygonal.

15. The reusable wax tree sprue rod assembly according to claim 1, wherein the reusable sprue rod further comprises a fixed heating element, the heating element being sized to fit within the tube of the sprue rod and running the entire length of the sprue rod.

16. The reusable wax tree sprue rod assembly according to claim 1, wherein the reusable sprue rod further comprises a removable heating element, the heating element being sized to fit within the tube of the sprue rod and running the entire length of the sprue rod.

17. The reusable wax tree sprue rod assembly according to claim 1, wherein the weight means and the locking means of the weight pull system are welded together to form a single unit.

18. The reusable wax tree sprue rod assembly according to claim 1, wherein the end member is welded into the reusable sprue rod to form a single unit.

19. The reusable wax tree sprue rod assembly according to claim 1, wherein the end member and sprue rod are a single piece of material, the end member being a machine cut extension of the reusable sprue rod.

20. A stackable reusable wax tree sprue rod assembly, comprising sprue rods according to claim 1, wherein the sprue rods are capable of being stacked to create a stacked sprue rod of the desired length, the stacked sprue rod comprising a top sprue rod and a bottom sprue rod, the top sprue rod's top end being engaged to an end cap according to claim 1, the bottom sprue rod's bottom end being engaged to an end member according to claim 1, the stacked sprue rod further comprising center sprue rods, the center sprue rods not engaging end members or end caps, the top sprue rod, bottom sprue rod and center sprue rods' top ends being capable of being press-fit into the sprue rods' bottom ends, the sprue rod assembly further comprising a weight means, a locking means, a circular rubber base, a circular puller base and a spring loaded latch according to claim 1.

21. The reusable wax tree sprue rod assembly according to claim 1, wherein the outer circumference of the locking means is threaded, the channel of the weight means is reverse threaded, and the locking means is capable of threading into the weight means.

22. A method of using a reusable sprue rod assembly according to claim 1, comprising the steps of:

a. dipping the reusable sprue rod into a reservoir of molten wax to lightly coat its entire length with wax;

b. inserting the locking means into the weight means by aligning the top end of the locking means and the bottom opening of the weight means and applying pressure until the locking means is completely inside the weight means;

c. inserting the bottom end of the sprue rod through the top opening in the weight means and into the center opening in the top end of the locking means in such a manner that the notches on the bottom end of the sprue rod engage the locking bar of the locking means;

d. rotating the locking means, resulting in the locking bar firmly engaging the horizontal portion of the notches of the sprue rod;

e. aligning the inner raised circle of the rubber base with the weight means and applying pressure until the rubber base firmly engages the weight means;

f. welding the wax patterns onto the sprue rod;

g. inserting a metal investment flask into the rubber base, interfacing the flask with the outer circle of the rubber base to hold the flask firmly in place;

h. pouring investment into the flask and waiting for the investment to harden;

i. pulling off the rubber base;

j. inserting the top end of the spring-loaded latch into the center hole in the bottom side of the puller base;

k. aligning the puller base with the flask, ensuring that the protrusions of the spring-loaded latch align with the notches of the locking means;

l. pressing the outer surface of the bottom side of the spring-loaded latch while inserting the top end of the latch into the bottom end of the locking means and rotating the bottom side of the latch to lock the protrusions into horizontal portion of the L-shaped notches of the locking means;

m. suspending the assembly with the puller base facing down in an oven or other heated or steam-filled space for dewaxing;

n. removing the sprue rod assembly from the oven or other space when it disengages from the investment mold; and o. following traditional dewaxing, heat-treating and casting procedures.

* * * * *